US005792276A

United States Patent [19]

Driessen

[11] Patent Number: 5,792,276

[45] Date of Patent: Aug. 11, 1998

[54] METHOD AND APPARATUS FOR CONTROLLING A DISHWASHER

[75] Inventor: Leo Peter Driessen, Victoria, Australia

[73] Assignee: Southcorp Manufacturing Pty. Ltd., Australia

[21] Appl. No.: 424,460

[22] PCT Filed: Oct. 29, 1993

[86] PCT No.: PCT/AU93/00561

§ 371 Date: Jul. 17, 1995

§ 102(e) Date: Jul. 17, 1995

[87] PCT Pub. No.: WO94/09693

PCT Pub. Date: May 11, 1994

[30] Foreign Application Priority Data

Oct. 30, 1992 [AU] Australia ..... PL5582/92

[51] Int. Cl.[6] ..... B08D 3/10

[52] U.S. Cl. ..... 134/18; 134/25.2; 134/34; 134/57 D; 134/58 D; 134/105

[58] Field of Search ..... 134/18, 19, 25.2, 134/34–35, 56 R, 57 R, 57 D, 56 D, 58 D, 105

[56] References Cited

U.S. PATENT DOCUMENTS

| | | | |
|---|---|---|---|
| 4,159,211 | 6/1979 | Hoffman et al. | 134/57 D |
| 4,241,400 | 12/1980 | Kiefer | 134/57 D |
| 4,289,543 | 9/1981 | Vallor | 134/25.2 |
| 4,743,820 | 5/1988 | Veach | 134/58 D |
| 5,331,984 | 7/1994 | Isagawa | 134/57 |

FOREIGN PATENT DOCUMENTS 4-097735 3/1992 Japan .

*Primary Examiner*—Jan Ludlow
*Attorney, Agent, or Firm*—Arnold, White & Durkee

[57] ABSTRACT

A dishwasher controlling apparatus and method in which account is taken of the temperature of the supply water which is input to the dishwasher for washing and/or rinsing purposes. Washing/rinsing of articles commences at the time water is supplied to the dishwasher, and the time taken for the water to be heated to a certain temperature is measured to determine the effectiveness of the washing/rinsing while the water is heated. Accordingly, the washing/rinsing duration which takes place when the water reaches a desired washing/rinsing temperature can be shortened without reducing washing/rinsing effectiveness, resulting in a time efficient washing and/or rinsing cycle.

12 Claims, 6 Drawing Sheets

METHOD AND APPARATUS FOR CONTROLLING A DISHWASHER

BACKGROUND OF THE INVENTION

1. Field of the Invention

This invention relates to dishwashing apparatus, and in particular to a method and apparatus for controlling a dishwasher.

2. Description of Related Art

In the field of dishwashing apparatus, it is known that hot water is generally more effective in washing than cold water. Consequently, dishwashers are sometimes provided with means for heating water input thereto for the purposes of washing and rinsing phases of the dishwasher. In use, a dishwasher generally runs through a cycle including a number of washing and rinsing phases which are timed by the use of cam timers or, more recently, electronic or hybrid timers. Typically, in a dishwasher, a thermostat is used to regulate the water temperature used in the wash and final rinse phases of the dishwashing cycle. Once the required temperature is reached, the wash or rinse phase continues for a fixed time. The disadvantage with such a system relates to variations in the time taken to reach the required temperature. For example, if the water input to a dishwasher is cold then the heating time will be vastly different from the time to reach the required temperature when hot water is input. This leads to a large variation in program duration, and means that a program optimised for cold water input will be far from optimum on hot water connection, and vice versa. This may also apply where variations in water supply temperature occur even without changing the input. For example, variations may occur where the hot water supply runs out of hot water, or where the hot water supply is distal from the location of the dishwasher and thus the temperature of water input to the dishwasher is not consistent, particularly on the initial fill when water in the pipes may have cooled, and or the pipes themselves are initially cold.

SUMMARY OF THE INVENTION

In accordance with the present invention, there is provided apparatus for controlling a dishwasher which includes heating means for heating washing and/or rinsing water, comprising means for determining a time period taken for said water to reach a first temperature when heated by said heating means, and controlling means effective to control a washing and/or rinsing duration of the dishwasher which occurs after the water reaches a second temperature on the basis of said time period.

The present invention also provides a method for controlling a dishwashing apparatus in which washing and/or rinsing water introduced thereto is heated by the apparatus, comprising the steps of measuring a time period required to heat said water to a first temperature, and controlling a washing and/or rinsing duration which occurs after said water reaches a second temperature on the basis of said time period.

Preferably, said first temperature is in the range 40° C. to 50° C., said second temperature is in the range 60° C. to 70° C., and said washing and/or rinsing duration is determined according to:

$$T=T_{preset}-MT_{heat}$$

where T is the calculated washing and/or rinsing duration;

$T_{preset}$ is the preset washing and/or rinsing time;

$T_{heat}$ is said time period taken to heat the water to the first temperature;

and M is a fraction in the range 0.1 to 0.5.

BRIEF DESCRIPTION OF THE DRAWINGS

The invention is described in greater detail hereinafter, by way of example only, with reference to the accompanying drawings in which like elements are referred to by like reference numbers throughout, wherein.

DETAILED DESCRIPTIONS

Figure 1:
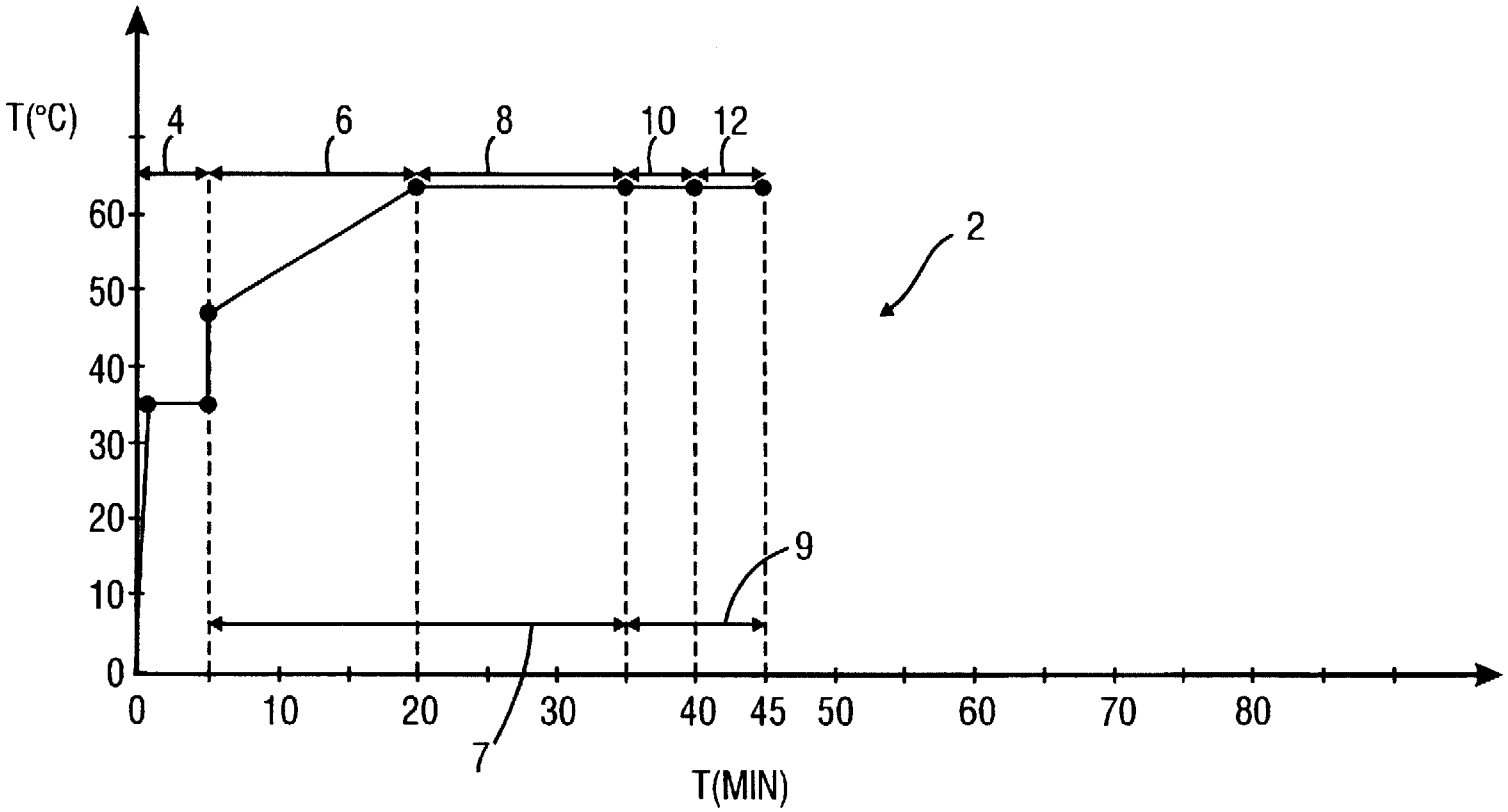
FIG. 1 (prior art)
FIG. 1 is a graph of water temperature against time in a prior art dishwashing cycle having a hot water connection.
Figure 2:
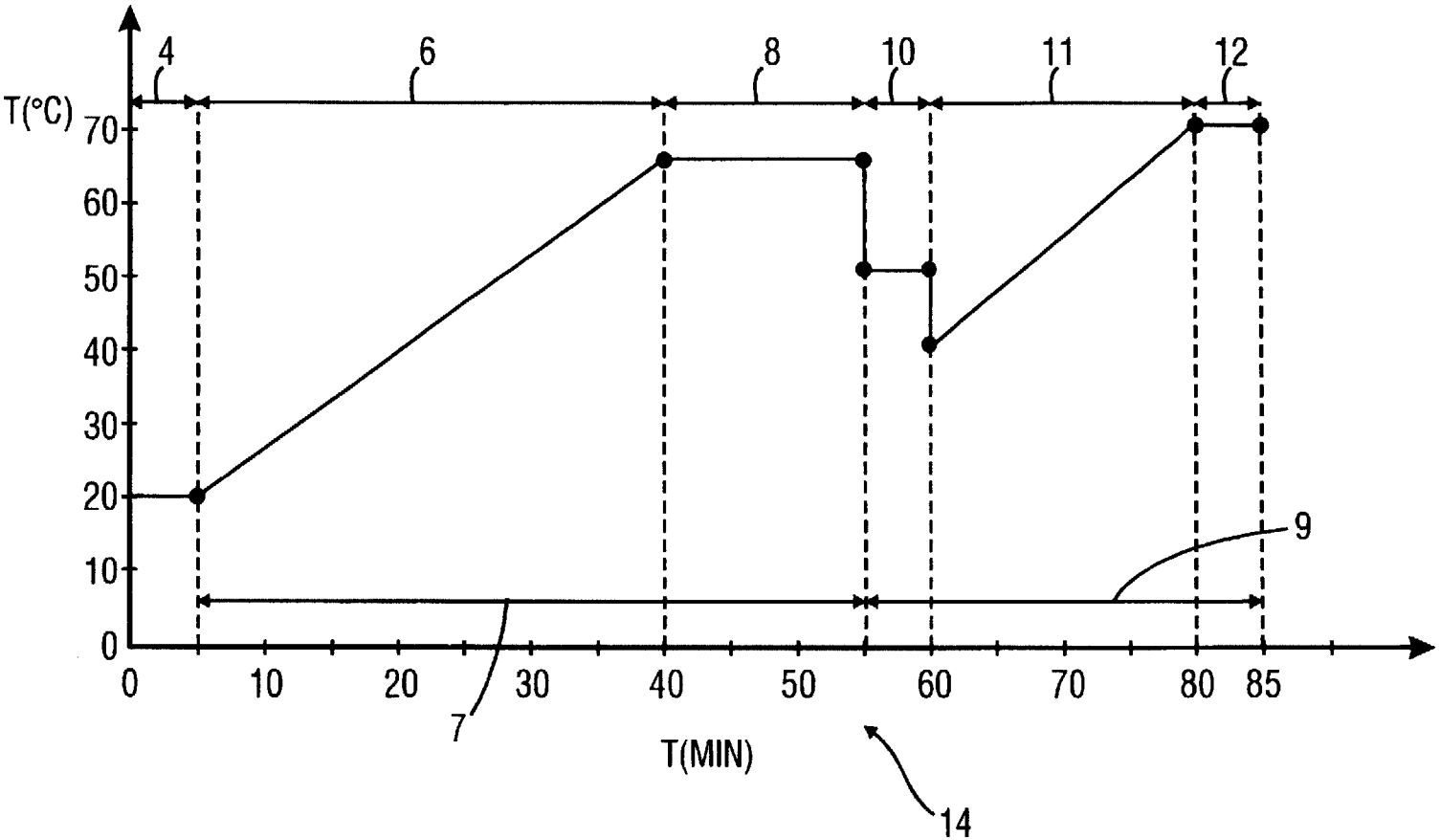
FIG. 2 (prior art)
FIG. 2 is a graph of water temperature against time for a prior art dishwashing cycle having a cold water connection.

FIGS. 1 and 2 are water temperature against time graphs relating to previously known dishwashing cycles. FIG. 1 indicates a dishwashing cycle 2 in which the dishwasher is provided with a connection to a source of hot water, and FIG. 2 indicates a cycle 14 where cold water is provided to the dishwasher. Cycle 14 in FIG. 2 shows the phases of water heating, washing, rinsing, etc. during a typical dishwasher cycle. The cycle begins with a pre-wash phase 4 in which water from the supply is introduced to the dishwasher chamber for a short period of time to loosen food and other material to be removed from articles in the dishwasher. A main wash heating phase 6 then commences in which water introduced to the dishwasher chamber is heated by a heating element, and at the same time washing takes place such as by action of water jets and the like, together with detergent. The main wash heating phase 6 generally continues until the wash water reaches a predetermined temperature, at which time a main wash fixed time phase 8 commences to thoroughly wash the dishwasher articles whilst the washing water is hot. The washing water is drained from the dishwasher chamber following the main wash fixed time phase 8, and rinse water is introduced for a first rinse phase 10. A rinse beating phase 11 then commences, wherein rinsing of the dishwasher articles takes place whilst the rinse water is heated by the dishwasher heating element. When the rinse water reaches a predetermined temperature a fixed time rinse phase 12 commences during which the dishwasher articles are thoroughly rinsed of food matter, detergent and the like. Following draining of the rinse water, the dishwashing cycle concludes, and the washed articles may be removed from the dishwashing chamber.

The dishwashing cycle 2 illustrated in FIG. 1 differs from the cycle 14 of FIG. 2 in that hot water is available for input to the dishwashing chamber as washing and rinsing water. This results in a shortened main wash heating phase 6, as is evident from a comparison of cycles 2 and 14 since less heating of the water is required to reach the required water temperature. Furthermore, since hot water is available directly for input from a hot water supply to the dishwasher, the rinse heating phase 11 shown in FIG. 2 is not required.

A difficulty which is associated with the control of a dishwashing cycle in accordance with FIGS. 1 and 2 relates to the total washing time 7 determined by the sum of the main wash heating phase 6 and main wash fixed time 8. It is clear from a comparison of cycles 2 and 14 that the total washing time 7 is much longer in the cold water cycle 14 than it is in the hot water cycle 2. Similarly with rinsing times, where it can be seen that a total rinse time 9 in the cycle 14 is much greater than that in cycle 2. Since washing and rinsing always occurs for a fixed period after the washing and rinsing water reaches the required temperature, it is possible that the washing and/or rinsing cycles are longer in the case of a cold water connection than is strictly necessary for effective cleaning and rinsing of the dishwasher articles.

Embodiments of the present invention may reduce unnecessary washing and/or rinsing times by optimising the washing time 7 and rinsing time 9 for all temperatures of input water. For example, due to the lower water temperature, the washing which occurs during the main wash beating phase 6 is necessarily not as effective as the washing which occurs during the main wash fixed time 8, but nevertheless the washing during phase 6 is still effective to remove some material from the dishwasher articles. Embodiments of the present invention aim to take the washing during phase 6 into account to determine an optimum duration for washing during phase 8. Similarly rinsing during phase 11 is accounted for in determining a duration for rinsing during phase 12. In a prior art wash cycle, the heating time of washing and rinsing water can be up to 45% of the total cycle duration. Even if washing during the main wash heating phase 6 is only 50% as effective as washing during the main wash fixed time 8, the wash cycle 14 for cold water connection may be reduced by 22%, and still achieve effective results, if the controlling method and apparatus of the preferred embodiment is utilised.

Figure 3:
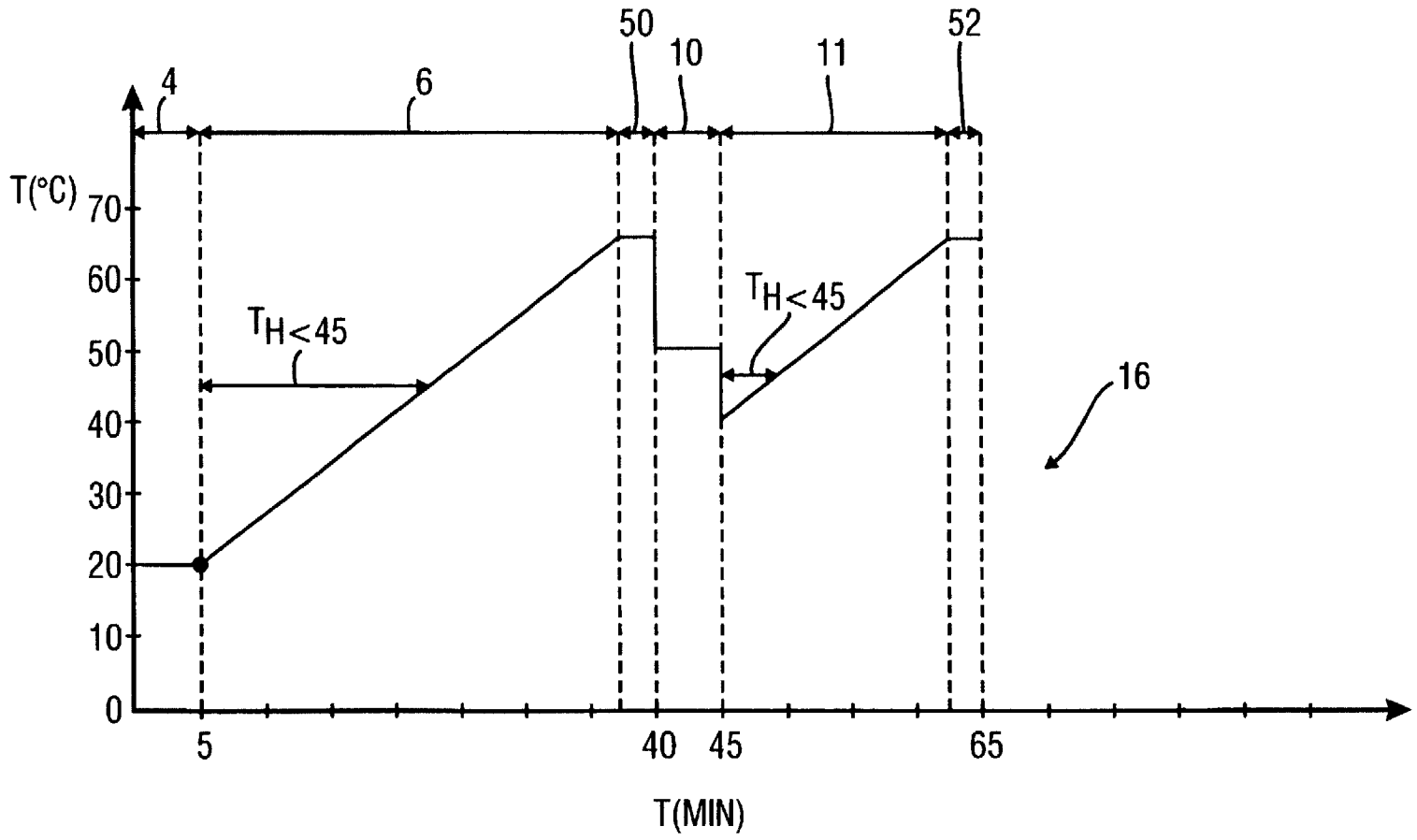
FIG. 3 is a graph of temperature against time illustrating an example of a dishwashing cycle in a dishwasher controlled in accordance with an embodiment of the invention.

FIG. 3 shows a dishwashing cycle 16 when controlled in accordance with the preferred embodiment, which illustrates shortening of the main wash fixed time 8 in accordance with time taken to heat washing water during the main wash heating phase 6. Similarly, the rinse fixed time 12 may be reduced according to heating of the rinse water during the rinse heating phase 11. The optimum proportion of the fixed time 8, 12 that is deducted is dependent upon the type of articles in the dishwashing chamber, and the type of material to be removed therefrom. In the preferred embodiment, however, a constant proportion of the time of the heating phase 6, 11 is deducted from the fixed time 8, 12. As an example, a relation between the heating phase time 6, 11 and the time to be deducted from the fixed time 8, 12 is as follows:

$$T_{FA}=T_{FB}-MT_{H<45}$$

where:

$T_{FA}$=Fixed time after deduction (Adjusted time)

$T_{FB}$=Fixed time before deduction $T_{H<45}$=Heating time taken to reach 45° C.

M=Correction factor (fraction)

As an example, the correction factor M may be set at 0.3, which has the effect of reducing washing and/or rinsing the fixed time 8, 12 by approximately one third of the time taken for the wash/rinse water to heat to 45° C.

This formula is put forward by way of example only, and it is in no way intended to be strictly limiting to the application of the invention. The temperature of 45° C. which has been chosen in this example as the temperature relevant to the time period measured during the heating phase 6, 11, relates to the temperature of 65° at which the main wash fixed time 8 and rinse fixed time 12 commences. Experimentally, it has been found that when water at 65° is introduced to a dishwasher containing articles in the dishwashing chamber at the ambient temperature, the water temperature which results after contact with the dishwasher articles is generally about 45° C. This has therefore been chosen as the temperature to sense for measurement of a period indicative of the length of time for heating of the washing/rinse water, although this, also, is not intended to be limiting. In practice an appropriate temperature may be selected from the temperature range between the input water temperature and the final wash/rinse water temperature.

Figure 4:
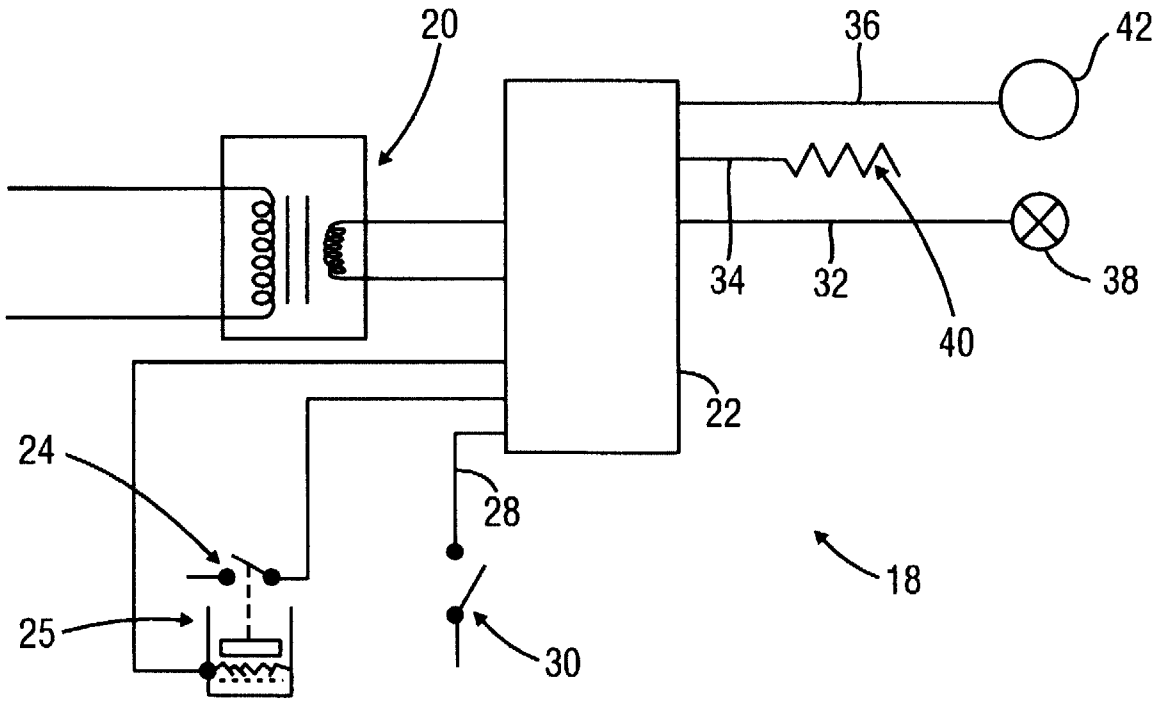
FIG. 4 is a schematic diagram of controlling apparatus in accordance with an embodiment of the invention.

FIG. 4 is a schematic diagram of a controlling circuit 18 for a dishwasher in accordance with the preferred embodiment. A micro processor controller 22 receives power from a power supply 20 and inputs from a water level sensor 24, a water temperature sensor 25, and a door sensor 30. The microprocessor controller 22 controls outputs to a water pump 42, a heating element 40, and a water inlet valve 38 in accordance with the method of the preferred embodiment described above, on the basis of the received inputs. In particular, the micro processor 22 includes a timing means (not shown) which is controlled by the micro processor software to measure a time period from the beginning of the main wash heating phase 6 to the point at which the temperature sensor 25 indicates a water temperature of 45° C. This time period ($T_{H<45}$) may then be utilised in a formula such as that described above or similar, to determine an adjusted time ($T_{FA}$), which may in turn be utilised to determine the total fixed temperature washing time 50 (see FIG. 3). Similarly, during the rinsing phases, the time taken for input rinse water to reach 45° C. may be taken into account in the way described to determine the time for the fixed temperature rinse phase 52 (FIG. 3).

Figure 5A:
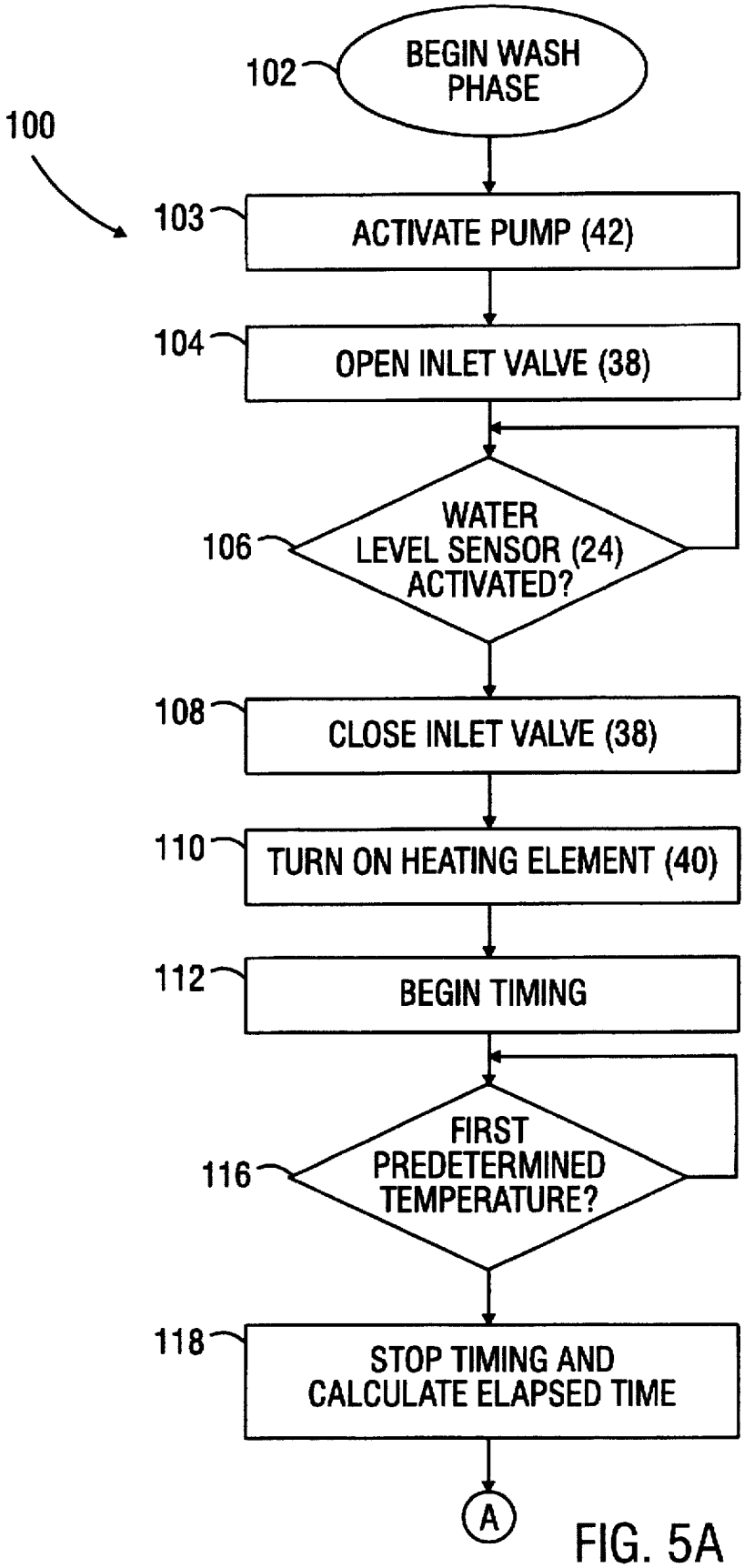
FIGS. 5A and 5B join at point "A" to form a flowchart illustrating the washing procedure of the embodiment of the invention.
Figure 5B:
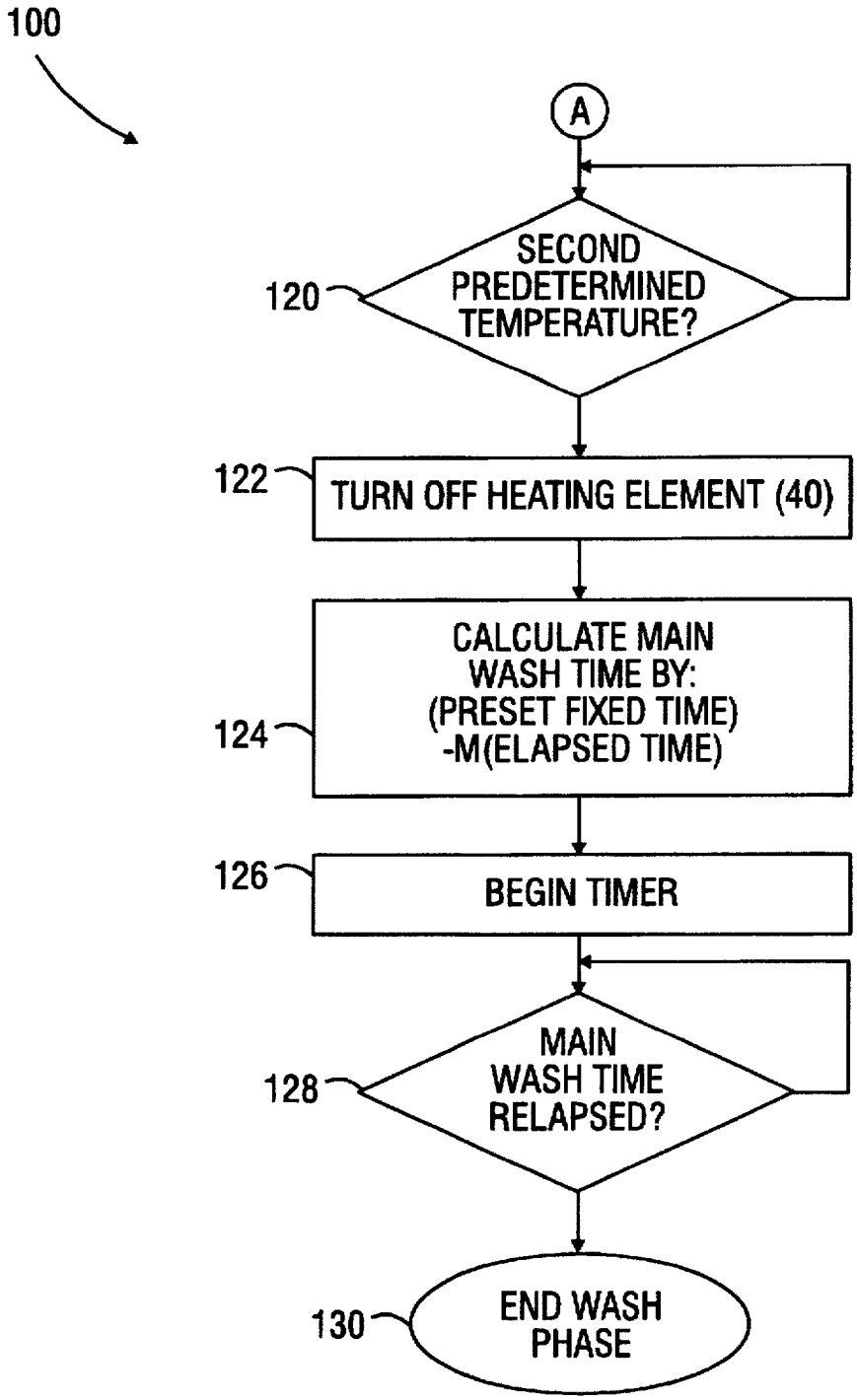

FIGS. 5A and 5B are respective portions of a flowchart 100, which join together at the point marked "A", which illustrate an example of procedural steps which may be undertaken by the microprocessor controller 22 under control of an appropriate software program in order to carry out a washing phase procedure according to an embodiment of the present invention. The procedure begins at step 102 which may correspond, for example, to the beginning of phase 6 illustrated in FIG. 3. The washing phase begins by activating the pump 42 so as to commence washing of articles in the dishwasher (step 103) whilst the inlet valve 38 is opened by action of the microprocessor controller 22 (step 104) in order to allow ingress of supply water into the dishwasher, until the dishwasher reservoir is full as indicated by the water level sensor 24 (step 106). Once sufficient water has been introduced into the dishwasher (step 106) the inlet valve 38 is closed again (step 108) after which the microprocessor controller 22 activates the heating element 40 in order to commence heating of the water in the dishwasher at step 110. At this time, also, the microprocessor 22 begins a timing operation (step 112) and the pump 42 continues to operate so as to wash the articles in the dishwasher with the water whilst it is being heated. During the washing procedure the microprocessor controller 22 monitors the temperature sensor 25 at step 116 to determine when the water temperature reaches the first predetermined temperature, such as 45° C. in the example described above. When the water reaches the first predetermined temperature the procedure continues to step 118 where the time elapsed during heating of the water to the first predetermined temperature is calculated from the internal timer of the microprocessor which was initiated at step 112.

Even after the water temperature reaches the first predetermined temperature the water continues to be heated by the heating element 40 whilst the water temperature as sensed by the temperature sensor 25 continues to be monitored by the microprocessor controller 22 (step 120). When the water temperature reaches the second predetermined temperature (step 120), such as 65° C. in the above described example, the heating element 40 is turned off by the microprocessor controller at step 122. The microprocessor then proceeds to calculate the duration required for the main wash phase which commences when the second predetermined water temperature is reached, by deducting a fraction M of the elapsed time period measured previously from a preset fixed time. The preset fixed time equates to the duration required of the main wash phase in the event that the water supplied to the dishwasher is at or above the second predetermined temperature, and may be of the order of 15 minutes. The fraction M of the heating elapsed time which is deducted from the preset fixed time may typically be around 0.3, as discussed above, such that, if the time taken to heat the water to the first predetermined temperature is say 15 minutes, the present fixed time may be reduced by about 5 minutes.

The calculated main wash time determined at step 124 is initiated into the internal timer of the microprocessor 22, which begins timing at step 126. The dishwasher then continues to wash the articles therein by action of the pump 42 with water at the second predetermined temperature until the main wash time has elapsed, as indicated by the timer (step 128). At this time the wash phase is at an end (step 130) and the pump is switched off and water released from the dishwasher, as appropriate. A thermostat arrangement may be included in the apparatus (not shown in the FIGS.) to control the heating element 40 so as to maintain the water at the second predetermined temperature during the main wash phase (step 128).

Although the procedure illustrated in FIGS. 5A and 5B have been described in relation to the washing phase of a dishwasher, the same procedure is clearly applicable also to the rinsing phase which occurs subsequently.

The described construction has been advanced merely by way of explanation, and many modifications may be made thereto without departing from the spirit and scope of the invention as defined in the claims appended hereto.

I claim:

1. Apparatus for controlling a dishwasher comprising means for determining a time period taken for washing and/or rinsing water to reach a first predetermined temperature when heated by heating means, and controlling means for controlling a washing and/or rinsing operation of the dishwasher, wherein said controlling means is effective to control a duration of the washing and/or rinsing operation which occurs after the water reaches a second predetermined temperature, said duration being determined by reducing a preset washing and/or rinsing time by a fraction of said time period.

2. Apparatus according to claim 1 wherein said first predetermined temperature is in the range 40° C. to 50° C., said second predetermined temperature is in the range 60° C. to 70° C., and the duration of said washing and/or rinsing operation which occurs after the water reaches said second predetermined temperature is determined by the controlling means according to:

$$T=T_{preset}-MT_{heat}$$

where T is the washing and/or rinsing duration;

$T_{preset}$ is the preset washing and/or rinsing time;

$T_{heat}$ is said time period; and

M is a fraction in the range 0.1 to 0.5.

3. Apparatus according to claim 1 including temperature sensing means, coupled to said controlling means, for sensing the temperature of said water and timing means, coupled to said controlling means, for measuring said time period, said time period comprising the time required for said water to be heated by said heating means from a supply temperature at which said water is introduced to the dishwasher to said first predetermined temperature, as sensed by said temperature sensing means.

4. Apparatus according to claim 3 wherein said second predetermined temperature is higher than said first predetermined temperature, and wherein said first predetermined temperature corresponds to a water temperature obtained when water at said second predetermined temperature is supplied to the dishwasher containing articles to be washed which are at ambient temperature.

5. Apparatus according to any one of claims 1, 3 or 4, including pump means for distributing said water within the dishwasher for washing and/or rinsing of articles therein, the pump means being controlled by the controlling means to distribute the water while the water is heated to the first predetermined temperature as well as during said washing and/or rinsing duration.

6. A method for controlling a dishwashing apparatus in which washing and/or rinsing water introduced thereto is heated by the apparatus, comprising the steps of measuring a time period required to heat said water to a first predetermined temperature, and controlling a washing and/or rinsing duration which occurs after said water reaches a second predetermined temperature, said duration being determined by deducting a fraction of said time period from a preset washing and/or rinsing time.

7. A method according to claim 6 wherein said first predetermined temperature is in the range 40° C. to 50° C., said second predetermined temperature is in the range 60° C. to 70° C., and said washing and/or rinsing duration is determined according to:

$$T=T_{preset}-MT_{heat}$$

where T is the washing and/or rinsing duration;

$T_{preset}$ is the preset washing and/or rinsing time;

$T_{heat}$ is said time period; and

M is a fraction in the range 0.1 to 0.5.

8. A method according to claim 6 wherein said time period is measured as the time taken for the water to be heated by the apparatus from a supply temperature at which the water is introduced into the apparatus to the first predetermined temperature, the water thereafter continuing to be heated by the apparatus to the second predetermined temperature.

9. A method according to claim 8 wherein said second predetermined temperature is higher than said first predetermined temperature and wherein said first predetermined temperature corresponds to a water temperature obtained when water at said second predetermined temperature is supplied to the dishwasher containing articles to be washed which are at ambient temperature.

10. A method according to any one of claims 6, 8 or 9, wherein said water is distributed within the apparatus for washing and/or rinsing of articles therein, the distribution of water taking place while the water is heated to the first predetermined temperature as well as during said washing and/or rinsing duration.

11. A dishwasher comprising a heater for heating washing and/or rinsing water, a water circulator for distributing the washing and/or rinsing water, and a controller for controlling the heater and water circulator, the controller comprising:

a temperature sensor for sensing the temperature of the washing and/or rinsing water; and a timer for measuring a time period taken for the washing and/or rinsing water to be heated by the heater from a supply temperature to a first predetermined temperature;

wherein said controller is effective to control said heater to heat the washing and/or rinsing water from said supply temperature to a second predetermined temperature higher than said first predetermined temperature, and to control said water circulator so as to distribute the washing and/or rinsing water during heating to said second predetermined temperature and thereafter for a preset time minus a selected fraction of said time period.

12. In a dishwasher having a heater for heating washing and/or rinsing water and a circulator for distributing the washing and/or rinsing water, a method of controlling a washing and/or rinsing operation comprising:

introducing washing and/or rinsing water into the dishwasher at a supply temperature;

heating and distributing the water in the dishwasher until the water reaches a second predetermined temperature;

measuring a time period required to heat the water from said supply temperature to a first predetermined temperature, lower than said second predetermined temperature; and continuing distribution of the water in the dishwasher after reaching said second predetermined temperature for a duration determined by deducting a fraction of the measured time period from a present washing and/or rinsing time.

* * * * *